US008252122B2

(12) United States Patent
Haake et al.

(10) Patent No.: US 8,252,122 B2
(45) Date of Patent: Aug. 28, 2012

(54) USE OF AN AGENT THAT CONTAINS CARBAMIDE AND/OR AT LEAST A DERIVATIVE THEREOF AS A CLEANING AGENT

(75) Inventors: Manfred Haake, Marburg-Cappel (DE); Klaus Becker, Hamburg (DE)

(73) Assignee: BBT Bergedorfer Biotechnik GmbH, Hamburg (DE)

( * ) Notice: Subject to any disclaimer, the term of this patent is extended or adjusted under 35 U.S.C. 154(b) by 235 days.

(21) Appl. No.: 12/608,157

(22) Filed: Oct. 29, 2009

(65) Prior Publication Data

US 2010/0240759 A1 Sep. 23, 2010

(30) Foreign Application Priority Data

Mar. 17, 2009 (EP) ..... 09003835
Jun. 9, 2009 (EP) ..... 09007638

(51) Int. Cl.
*C11D 17/00* (2006.01)

(52) U.S. Cl. ..... 134/42; 134/25.2; 510/220; 510/225

(58) Field of Classification Search ..... 134/42, 134/25.2; 510/220, 225
See application file for complete search history.

(56) References Cited

U.S. PATENT DOCUMENTS

| | | | | |
|---|---|---|---|---|
| 5,474,698 | A | 12/1995 | Rolando et al. | |
| 6,432,906 | B1 | 8/2002 | Carlson et al. | |
| 7,510,859 | B2 * | 3/2009 | Wieland et al. | 435/197 |
| 7,807,616 | B2 * | 10/2010 | Meine et al. | 512/1 |
| 7,828,905 | B2 * | 11/2010 | Smith et al. | 134/18 |
| 7,922,827 | B2 * | 4/2011 | Smith et al. | 134/18 |
| 7,922,828 | B2 * | 4/2011 | Smith et al. | 134/18 |
| 7,960,329 | B2 * | 6/2011 | Smith et al. | 510/232 |
| 2004/0014622 | A1 | 1/2004 | Becker | |
| 2005/0170985 | A1 | 8/2005 | Huish et al. | |
| 2005/0281773 | A1 * | 12/2005 | Wieland et al. | 424/70.14 |
| 2006/0070189 | A1 * | 4/2006 | Raehse et al. | 8/115.51 |
| 2007/0128129 | A1 * | 6/2007 | Stehr et al. | 424/50 |
| 2007/0203049 | A1 | 8/2007 | Thomson | |
| 2007/0265183 | A1 * | 11/2007 | Meine et al. | 512/3 |
| 2008/0207481 | A1 * | 8/2008 | Meine et al. | 512/4 |
| 2008/0221003 | A1 * | 9/2008 | Meine et al. | 510/103 |
| 2008/0274936 | A1 | 11/2008 | Adamy et al. | |
| 2008/0287335 | A1 * | 11/2008 | Smith | 510/220 |
| 2009/0170744 | A1 * | 7/2009 | Meine et al. | 510/302 |
| 2010/0240759 | A1 * | 9/2010 | Haake et al. | 514/588 |
| 2010/0330013 | A1 * | 12/2010 | O'Connell et al. | 424/62 |
| 2011/0152156 | A1 | 6/2011 | Sauter et al. | |

FOREIGN PATENT DOCUMENTS

| | | | |
|---|---|---|---|
| CA | 2380021 | A1 | 11/2000 |
| DE | 1692024 | | 6/1967 |
| DE | 2404494 | A1 | 8/1975 |
| DE | 3833047 | A1 | 4/1990 |
| DE | 199 23 943 | A1 | 5/1999 |
| DE | 19921443 | A1 | 11/2000 |
| EP | 0262358 | A1 | 8/1987 |
| EP | 1354938 | A1 | 10/2003 |
| GB | 2179053 | A | 2/1987 |
| GB | 2272449 | A | 5/1994 |
| RU | 2131914 | C1 | 6/1999 |
| WO | 0071056 | A1 | 11/2000 |
| WO | 0244309 | A2 | 6/2002 |
| WO | 2008101810 | A1 | 8/2008 |
| WO | 2008146177 | A1 | 12/2008 |

* cited by examiner

*Primary Examiner* — Gregory Webb
(74) *Attorney, Agent, or Firm* — Karl F. Milde, Jr.; Eckert Seamans Cherin & Mellott, LLC

(57) ABSTRACT

The invention relates to the use of an agent that contains 5 to 99.9% in weight of carbamide and/or at least a derivative thereof, as a cleaning agent for closed systems, in particular as a dishwasher detergent, as a laundry detergent for washing machines, as an agent for cleaning, sanitizing and/or disinfecting for equipment in the food processing industry and for medical equipment, the use as a hand dishwashing detergent or sanitary cleaner or as a hand cleaner. In addition, the invention relates to a method for reducing or avoiding enzymes in cleaning agents for closed systems, in hand dishwashing detergents or in sanitary cleaning agents as well as an enzyme-free dishwashing detergent or enzyme-free sanitary cleaning agent that contain 5 to 99.9% in weight of carbamides or derivates thereof. Finally, the invention relates to the use of percarbamide as a bleaching agent in particular in dishwashing detergents and in sanitary toilet cleaning agents.

30 Claims, No Drawings

USE OF AN AGENT THAT CONTAINS CARBAMIDE AND/OR AT LEAST A DERIVATIVE THEREOF AS A CLEANING AGENT

BACKGROUND OF THE INVENTION

The invention relates to the use of an agent whose weight contains 5 to 99.9% carbamide and/or at least a derivative thereof, as a cleaning agent for closed systems, in particular as a dishwasher detergent, as a laundry detergent for washing machines, as an agent for cleaning, sanitizing and/or disinfecting equipment in the food processing industry and for medical equipment, as a hand dishwashing detergent or sanitary cleaning agent or as a hand cleaner. In addition, the invention relates to a method for reducing or avoiding enzymes in dishwashing detergents or in sanitary cleaning agents as well as an enzyme-free dishwashing detergent or enzyme-free sanitary cleaning agent whose weight contains 5 to 99.9% carbamides or derivatives thereof. In addition, the invention relates to the use of percarbamide as a bleaching agent preferably in dishwashing detergents or in sanitary cleaning agents, in particular in sanitary toilet cleaning agents.

According to the invention, closed systems refers to devices that are either fully closed off to their surroundings during operation, for example dishwashers, washing machines or the like, or are hermetically closed off from the surroundings prior to their operation and are opened only upon start-up, for example equipment for food processing or also medical equipment such as rinsing devices for operating rooms and dentist chairs, dialysis equipment, cardiopulmonary machines, endoscopes and similar medical equipment. While in the first-mentioned systems the cleaning agent circulates in the equipment during operation, in the latter-named systems, the system is rinsed with the cleaning agent. Here, the cleaning agent not only serves cleaning purposes but is also used for sanitizing and/or potentially for disinfecting.

SUMMARY OF THE INVENTION

Cleaning agents for closed systems such as dishwasher detergents, laundry detergents for washing machines, hand dishwashing detergents and sanitary cleaning agents are agents that are used in almost every household. Modern dishwashing detergents such as the ones described in WO 2007/141257 typically contain tensides, detergent builders, bleaching agents and enzymes as significant components. Enzymes are molecules, in particular proteins that can catalyze a certain chemical reaction. Enzymes play an important role in the metabolism of all living organisms; they catalyze and control many biochemical reactions, e.g., during copying (DNA polymerase) or transcribing (RNA polymerase) the genetic information. Enzymes used in dishwasher detergents are, for example, proteases, amylases, catalases, peroxidases, cellulases and/or lipases. Preferred is the use of proteases.

Enzymes are relatively expensive compared to the other components of a modern cleaning agent for closed systems, dishwashing detergents or sanitary cleaners. Despite the use of expensive enzymes, the cleaning effect of modern cleaning agents such as dishwashing detergents is often just satisfactory. In addition, the use of enzymes is often accompanied by disadvantages; for example the dishwashing detergents can be used only within a certain temperature and pH-value range, and stability problems can occur, in particular with longer storage. Finally, it is problematic in considering environmental viewpoints when an uncontrolled enzyme amount enters the waste water. Furthermore, handling enzymes during manufacturing or use of enzyme-containing products is not unproblematic (e.g., allergy potential).

It was, therefore, the objective of the invention to overcome the aforementioned disadvantages.

It was, in particular, the objective of the invention to provide a cleaning agent for closed systems, a hand dishwashing detergent or a sanitary cleaning agent that exhibits a high cleaning effect. Despite the high cleaning effect, the cleaning agent or the dishwashing detergent, respectively, or the sanitary cleaning agent shall be surface-friendly. In addition, its use shall be possible over a wide pH-value range (neutral, alkaline, acidic).

In the case of a dishwashing detergent, it was the objective of the invention to provide an agent that can be used over a broad temperature range, in particular from 15° C. to 70° C. or 15° C. to 80° C., and that achieves an advantageous cleaning effect over as wide a temperature range as possible. It should be possible to use it for both household dishwashers as well as commercial dishwashers. Furthermore, the cleaning agent should provide glass-friendly cleaning.

Carbamide is a neutral, odorless, non-toxic product with very good water solubility that is eliminated by the human organism as an end product of the nitrogen metabolism in amounts of 20 to 30 g per day and that counts among the most environmentally friendly substances in nature. There, it can be broken down into its components through chemical decomposition, or it can be stored in the form of water-soluble or non-soluble salts (e.g., as Ca carbonate and/or Mg carbonate).

Under this aspect, carbamide—which can be regarded chemically as a diamide of carbonic acid—can be viewed as the bound form of the two gaseous components $NH_3$ and $CO_2$ (at a ratio of 2:1), from which it can be manufactured commercially on a huge scale due to its use in the areas of fertilizer and synthetic resins.

Through the inventive recommended use of carbamide in cleaning agents a significant contribution is made to environmental protection through the increased use of carbamide in the cleaning sector through the binding of $CO_2$ gas during the technical production, the use as a cleaning agent and the disposal in nature into harmless salts (in particular carbonates and hydrogen carbonates).

For environmental and cost reasons it shall be made possible to reduce the amount of enzymes that are typically used in conventional cleaning agents. In particular it shall become possible to avoid the use of enzymes entirely.

Preferably only biodegradable and/or bio-reclaimable substances shall be used, in particular those biodegradable according to EN ISO 14593: 199 (CO2 headspace test).

Unexpectedly, the objectives of the current invention could be solved through the use of an agent with high carbamide content.

The object of the invention is, therefore, the use of an agent whose weight contains 5 to 99.9% carbamide or derivatives thereof, relative to the total weight of the agent, as a cleaning agent for closed systems, in particular as a dishwasher detergent, as a laundry detergent for washing machines, as an agent for cleaning, sanitizing and/or disinfecting for equipment in the food processing industry or for medical equipment, as a hand dishwashing detergent or as a sanitary cleaning agent, in particular a sanitary toilet cleaning agent.

Furthermore, the object of the invention is a method for reducing or avoiding enzymes in cleaning agents for closed systems, in particular in dishwasher detergents, in laundry detergents for washing machines, in agents for cleaning, sanitizing and/or disinfecting for equipment in the food processing industry or for medical equipment, in hand dishwashing detergents or in sanitary cleaning agents, characterized in that for an enzyme-containing cleaning agent, in an enzyme-containing hand dishwashing detergent or an enzyme-containing sanitary cleaning agent a certain amount of enzymes is replaced by 5 to 50 times the amount of carbamide or derivatives thereof.

Furthermore, the object of the invention is an enzyme-free cleaning agent for closed systems, in particular an enzyme-free agent for cleaning, sanitizing and/or disinfecting, an enzyme-free dishwashing detergent or an enzyme-free sanitary cleaning agent whose weight is 5 to 99.9% carbamide or derivatives thereof, relative to the total weight of the enzyme-free dishwashing detergent or the enzyme-free sanitary cleaning agent.

Finally, the object of the invention is the use of percarbamide as a bleaching agent in dishwashing detergents, in particular for removing tar residue on dishes or glasses as well as in sanitary toilet cleaners for removing organic stains.

With regard to the use of the agent as a sanitary cleaning agent it shall be mentioned supplementary that the sanitary cleaning agent remains on the surface to be cleaned only during the actual cleaning process, for example on the ceramic surface of the toilet, and that is fully rinsed off after cleaning is completed such that the generation of odors as occurs during the degradation of the carbamide is prevented.

The explanations below concern—unless otherwise stated—the cleaning agent according to the invention for closed systems (in particular enzyme-free agents for cleaning, sanitizing and/or disinfecting), the inventive enzyme-free dishwashing detergent, the inventive enzyme-free sanitary cleaning agent and the agent according to the inventive use. To improve clarity, reference will be made only to the "agent according to the invention".

The agent according to the invention (i.e., also the inventive enzyme-free dishwashing detergent, the inventive enzyme-free sanitary cleaning agent) contains 5 to 99.9% in weight, preferably 10 to 95% in weight, more preferred 20 to 90% in weight, even more preferred 25 to 80% in weight, in particular preferred 30 to 75% in weight, very particularly preferred 35 to 70% in weight and especially 40 to 60% in weight carbamide or derivatives thereof, relative to the total weight of the agent.

In contrast to these high amounts, carbamide has been used in dishwashing detergents and sanitary cleaning agents of the prior art only as an additive in marginal amounts. For example, DE 199 23 943 A1 discloses a sanitary cleaning agent in which carbamide was used as a germ-promoting organic substance in an amount of about 0.5% in weight. However, in this case carbamide was not used for improving the cleaning effect and for solving the aforementioned objectives.

Carbamide (also known as urea) exhibits the following chemical structure according to formula (I).

1.

(I)

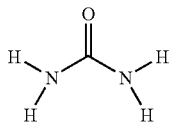

However, the invention relates not only to carbamide but also to derivatives of carbamide. Compounds of the formula (II) are preferred for use as derivatives,

1.

(II)

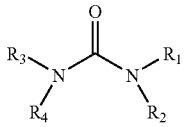

where the residues $R_1$, $R_2$, $R_3$ and $R_4$ are present independent of each other open-chained or cyclized and can have the following meaning: An alkaline group with 1 to 4 carbon atoms, a cycloalkyl group with 3 to 6 carbon atoms, an aryl group in the form of a phenyl or naphthyl residue, an aralkyl group with 7 to 18 carbon atoms, or an O—, S—, or N—containing heterocyclical group with 2 to 5 carbon atoms.

In particular the methyl, ethyl, n-propyl, i-propyl as well as the various isomers of the butyl group come into consideration as the alkyl group with 1 to 4 carbon atoms. Among the cycloalkyl group with 3 to 6 carbon atoms are in particular the cyclopropyl, cyclobutyl, cyclopentyl as well as the cyclohexyl residues, among the aralkyl group with 7 to 18 carbon atoms in particular the benzyl and phenethyl group, among the alkylaryl group with 7 to 18 carbon atoms in particular the tolyl group and under the heterocyclic group with 2 to 5 carbon atoms in particular those with at least oxygen, sulfur or nitrogen atom in the heterocyclic ring, where the radicals of oxirane, tetrahydrofuran, dioxane as well as pyran can be named as suitable examples.

In addition, the residues $R_1$ to $R_4$ can be present in a cyclized manner, i.e., carbamide derivatives of the formulas (IIa), (IIb) (IIc), and (IId), for example, can also fall under the aforementioned formula (II).

(IIa)

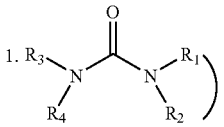

(IIb)

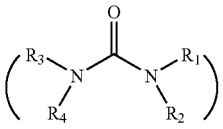

(IIc)

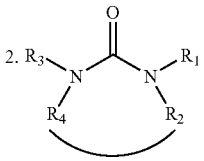

(IId)

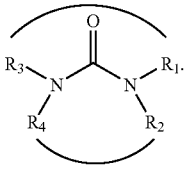

The term "derivatives" also includes dimers and trimers of the compounds of the formulas (I) and (II).

In one possible embodiment, the carbamide dimer (biuret) is used as a derivative according to the formula (III):

1.

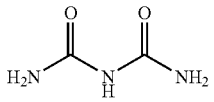

(III)

Furthermore, the term "derivative" also includes salts, solvates, hydrates and other adducts of the compounds mentioned above under formulas (I) to (III).

Finally, it is also possible to use carbamide derivative mixtures or mixtures of carbamide and carbamide derivatives. Particularly preferred is the use of carbamide in the agent according to the invention.

According to the invention, the agent of the present invention will be used as a cleaning agent for closed systems such as dishwashers or washing machines, as an agent for cleaning, sanitizing and/or disinfecting of equipment in the food industry and of medical equipment, as dishwashing detergent or as a sanitary cleaning agent.

The cleaning agent according to the invention can be used for closed systems. With appropriate dosing of the carbamide, it can also be used as an agent for cleaning, sanitizing and/or disinfecting of equipment in the food industry and of medical equipment.

In general, dishwashing detergents are used as an agent for cleaning dishes. The agent according to the invention can be used both as a dishwasher detergent and as a hand dishwashing detergent. Its preferred use is as a dishwasher detergent, in particular for both commercial dishwashers and household dishwashers.

In general, sanitary cleaning agents are used for cleaning sanitary surfaces. The preferred use of the agent according to the invention is the cleaning of toilet bowls or urinals. Thus, preferably the sanitary cleaning agent is a toilet cleaning agent.

In addition to carbamide and/or derivatives thereof, the agent according to the invention can also contain tensides such as anionic, nonionic, cationic and/or amphoteric tensides. Also any mixtures of the tensides explained below are possible.

In one preferred embodiment, the agent according to the invention contains 0.01 to 30% in weight, more preferably 0.1 to 20% in weight, even more preferred 1 to 15% in weight, particularly preferred 2 to 12% in weight, especially 3 to 10% in weight of anionic tensides, relative to the total weight of the agent.

In general, anionic tensides refer to tensides that include a negatively charged functional group. Typically, anionic tensides are made of polar and non-polar portions. Preferably a $C_6$-$C_{30}$-alkyl residue serves as the non-polar portion. The polar functional group is preferably —COO-(carboxylate), —$SO_3^-$(sulfonate) or —O—$SO_3^-$(Sulfate).

Examples for this are:

Alkyl carboxylates of the formula R—$COO^-Na^+$, where R is an organic residue with 6 to 30, preferably 8 to 16 carbon atoms;

Alkyl benzenesulfonates (ABS) of the formula $C_nH_{2n+1}$—$C_6H_4$—$SO_3^-Na^+$, where n is 6 to 30, preferably 8 to 16, (e.g., sodium dodecylbenzenesulfonate);

Secondary alkanesulfonates (SAS) of the formula $C_nH_{2n+1}$—$SO_3^-Na^+$, where n is 6 to 30, preferably 8 to 16; and Fatty alcohol sulfates (FAS) of the formula $H_3C$—$(CH_2)_n$—$CH_2$—O—$SO_3^-Na^+$, where n is 6 to 30, preferably 8 to 16 (for example sodium laurylsulfate).

Preferably, $C_{9-15}$-alkyl benzenesulfonates and olefinsulfonates are taken into consideration as the sulfonate-type tensides. Also suitable are alkane sulfonates that are obtained from $C_{12-20}$-alkanes for example through sulfochlorination or sulfoxidation with subsequent hydrolysis or neutralization. Also suitable are esters of α-sulfo-fatty acids (ester sulfonates),e.g., the α-sulfonated methyl esters of the hydrated coconut, palm kernel or tallow fatty acids.

Additional suitable anion tensides are sulfonated fatty acid glycerin esters. Fatty acid glycerin esters refers to monoesters, diesters and triesters as well as their mixtures. Preferred sulfonated fatty acid glycerin esters are sulfonated products of saturated fatty acids with 6 to 22 carbon atoms, for example of the caproic acid, caprylic acid, myristic acid, palmitic acid, stearic acid or behenic acid.

An additional class of anion tensides is the class of ether carboxylic acids accessible through the conversion of fatty alcohol ethoxylates with sodium chloroacetate in the presence of alkaline catalysts. Suitable anionic tensides are also the partial esters of di- or polyhydroxy alkanes, mono- and disaccharides, polyethylene glycols with the en-adducts of maleic acid anhydride at least mono-unsaturated carbonic acids with a chain length of 10 to 25 carbon atoms and preferred with an acid number of 15 to 130. Alternatively usable anionic tensides are sulfosuccinatea, sulfosuccinamates and sulfosuccinamides, in particular sulfosuccinates and Sulfosuccinamates, and particularly preferred sulfosuccinates.

In one preferred embodiment, the agent according to the invention contains 0.01 to 20% in weight, more preferably 0.1 to 10% in weight, even more preferred 0.5 to 5% in weight, particularly preferred 1 to 4, especially 1.5 to 3% in weight of non-ionic tensides, relative to the total weight of the agent.

Generally, nonionic tensides refer to tensides that essentially contain no dissociable functional groups and, therefore, do not dissociate into ions when in water. As any tenside, the nonionic tensides are also made up of a non-polar and a polar component. As non-polar portion, the nonionic tensides contain preferred a fatty alcohol (e.g., $C_{12}$-$C_{18}$) or e.g., an octyl or nonyl phenol residue. As the polar portion, the nonionic tensides contain preferred the hydroxyl groups or ether groups.

Examples for nonionic tensides are:

1. Polyalkylene glycol ether;
2. Fatty alcohol ethoxylates (FAEO), in particular of the formula $CH_3$—$(CH_2)_{10-16}$—$(O—C_2H_4)_{1-25}$—OH;
3. Fatty alcohol propoxylates (FAPO), in particular of the formula $CH_3$—$(CH_2)_{10-16}$—$(O—C_3H_6)_{1-25}$—OH alkyl glucosides;
4. Alkyl glucosides (APG), in particular of the formula CH3-$(CH_2)_{10-16}$—(O-Glykosid)$_{1-3}$-OH;
5. Oktyl phenolethoxylates, in particular of the formula C8H17-$(C_6H_4)$—$(O—C_2H4)_{1-25}$-OH; and/or
6. Nonylphenol ethoxylates, in particular of the formula C9H19-$(C_6H_4)$—$(O—C_2H_4)_{1-25}$—OH.

Potentially, the cleaning agent according to the invention can also contain cationic tensides, for example in an amount of 0.1 to 10% in weight, preferably 1 to 5% in weight, relative to the total weight of the agent.

Cationic tensides refer to tensides that include a positively charged functional group. Preferably, these are quaternary ammonium compounds of the formula $R_1R_2R_3R_4N^+X^-$, where $R_1$ to $R_4$ are organic residues with 4 to 20 carbon atoms, preferably stearyl, palmityl, methyl, benzyl, butyl residues, and where X is a gegenion, preferably a halide.

Potentially, the cleaning agent according to the invention can also contain amphoteric tensides, for example in an amount of 0.1 to 20% in weight, preferably 5 to 10% in weight, relative to the total weight of the agent.

Amphoteric tensides refer to tensides that include both a negatively and a positively charged functional group. Preferably an alkyl group serves as the non-polar portion, and a carboxylate group (R—COO—) and a quaternary ammonium group as the polar portion.

In the case of dishwashing detergents, a preferred embodiment uses, in particular, polyoxyethylene sorbitan monooleate (e.g., obtainable as Tween® 80) and/or a $C_{12}$-$C_{14}$ alcohol polyethylene glycol ether (obtainable as Marlox® MO 154, for example) as tensides. This demonstrated an advantageous stability in liquid dishwashing detergents.

In one preferred embodiment, the agent according to the invention contains 0.1 to 60% in weight, more preferably 1 to 50% in weight, even more preferred 5 to 40% in weight, particularly preferred 10 to 30% in weight, especially 15 to 25% in weight of detergent builders, relative to the total weight of the agent.

Detergent builders or simply builders essentially serve as transport aids.

Water-soluble substances or non-water-soluble substances such as aluminosilicates and in particular zeolites are used as builders.

Zeolites suitable as builders include for example, zeolite A, zeolite X, zeolite Y and zeolite P.

Suitable zeolites are usually available as particular composition with a mean particle size by volume (D50) of 0.1 μm to 100 μm, preferably of 0.5 μm to 50 μm and especially of 1 μm to 30 μm (determined using the Mastersizer 2000 and evaluated using the Fraunhofer method). Preferably, the zeolites used contain 15 to 25% in weight on bound water and especially 20 to 22% in weight.

Other suitable builders are, for example, polyacetales, which can be obtained by converting dialdehydes using polyolcarboxylic acids that preferably exhibit 5 to 7 C atoms and at least 3 hydroxyl groups. Preferred polyacetales are obtained from dialdehydes such as glyoxal, glutaraldehyde, terephthalaldehyde as well as mixtures thereof and of polyolcarboxylic acids such as gluconic acid and/or glucoheptonic acid.

Other suitable organic builders are dextrins, i.e., oligomers or polymers of carbohydrates that can be obtained through the partial hydrolysis of starches. In addition, polyacrylates, pectinates and alginates can be used as builders.

It is also possible to use citrate builders, e.g., citric acid and/or the soluble salts thereof as builders.

As an alternative, phosphate basis builders may also be used. However, for environmental reasons these are not preferred. Examples are sodium tripolyphosphates, sodium pyrophosphate and sodium orthophosphate. Preferably, the cleaning agent subject to the invention is phosphate-free.

In one preferred embodiment, the agent according to the invention contains 0.01 to 20% in weight, more preferably 0.1 to 10% in weight, even more preferred 0.5 to 5% in weight, particularly preferred 1 to 4% in weight, especially 1.5 to 3% in weight of bleaching agents, relative to the total weight of the agent.

In general, bleaching agents are substances that diminish the strength of the color of substances, in particular of food residue, either fully or in part.

Preferably, a "hydrogen peroxide source" is used as a bleaching agent.

A source for hydrogen peroxide can be hydrogen peroxide or a compound that is able to release hydrogen peroxide. For example, perborates, e.g., sodium perborate (in any hydrated form, however, preferably as monohydrate or tetrahydrate), sodium carbonate peroxyhydrate or equivalent percarbonate salts, sodium pyrophosphate peroxyhydrate or sodium peroxide can be used. Also useful are sources for available oxygen such as persulfate bleaches. Sodium perborate monohydrate and sodium percarbonate are preferred. Mixtures of useful hydrogen peroxide sources can be used as well.

As a bleaching agent the use of percarbamide is particularly preferred. Here, percarbamide (CAS number 124-43-6) refers to the crystalline adduct of $H_2O_2$ and carbamide.

As an alternative, a chlorine basis bleaching agent can be used as well.

In one preferred embodiment, the agent according to the invention contains 0.01 to 20% in weight, more preferably 0.1 to 10% in weight, even more preferred 0.5 to 5% in weight, particularly preferred 1 to 4% in weight, especially 1.5 to 3% in weight of pH adjusters, relative to the total weight of the agent.

The pH adjuster is used for setting a suitable pH value of the agent (or if it is an agent in solid form, to set the pH value of a 1-molar solution of the agent in water).

Preferably, a pH value of 7 to 12, in particular of 8 to 11 is set for dishwashing detergents.

Preferably, the pH adjuster is an alkaline agent. Preferably, the alkaline agent is available in the form of an alkaline active alkaline salt and/or earth alkaline salt and/or an alkaline and/or earth alkaline hydroxide. In these compounds, sodium is preferred as the alkaline metal. It is particularly preferred if the alkaline effective agent contains a mixture of sodium hydrogen carbonate and sodium carbonate. Particularly advantageous results are achieved when the mixture of sodium carbonate and sodium hydrogen carbonate is compounded such that about 2 to 4, in particular 2.8 to 3.3 parts by weight of sodium carbonate are allotted to one part by weight of sodium hydrogen carbonate. This mixture then also adjusts the pH range to about 8 to 11, in particular to about 9 to 10.

Preferably, an acidic pH value of 1 to 6, in particular of 2 to 4 is set for sanitary cleaning agents for dissolving calcifications.

Preferably, the pH adjuster in this case is an acidifying agent. Preferably, both inorganic and organic water-soluble free acids, as well as their anhydrides and their acidic salts are used. Aside from sodium hydrogen sulfate and/or carbamide phosphate, in particular organic α-hydroxy carbonic acids (fruit acids) such as citric acid, tartaric acid, etc., for example, and or their anhydride can be used advantageously.

In one preferred embodiment, the agent according to the invention contains 0.01 to 20% in weight, more preferably 0.1 to 10% in weight, even more preferred 0.5 to 5% in weight, particularly preferred 1 to 4% in weight, especially 1.5 to 3% in weight of chelating agents, relative to the total weight of the agent.

Chelating agents are ligands that exhibit two or more binding sites. In this manner they form particularly stable complexes with polyvalent metal ions. Examples for chelating agents are nitrilo triacetate (NTA), ethylene diaminotriacetate (TED), ethylene diamine tetraacetate (EDTA), oxalate, tartrate and/or citrate.

In one preferred embodiment, the agent according to the invention also includes one or more stabilizers. Here, solubilizing and/or dispersion-promoting components typically serve as the stabilizers. Preferably, polyalcohols are used as stabilizers. Polyalcohol refers to substances that include two or more alcohol groups. Examples for suitable stabilizers are glycol, propylene glycol, polyalkylene glycol, in particular polyethylene glycol (e.g., Pluriol®), polypropylene glycol, glycerol, sorbitol, mannitol or mixtures thereof.

The agent according to the invention contains stabilizers usually in amount of 0.01 to 20% in weight, preferably of 0.1 to 5% in weight, in particular if it is an agent according to the invention in liquid form.

In a preferred embodiment, the agent according to the invention can also contain an antibacterial and/or antimycotic and/or antimicrobial additive, in particular in the case of liquid preparation. The antibacterial and/or antimycotic and/or antimicrobial additive(s) is/are typically included in amount of 0.01 to 5% in weight, preferably of 0.1 to 2% in weight. For example, food chemistry approved preserving agents such as sodium formiate, sodium sorbate or PHB ester as well as suitable additives with an antimicrobial effect spectrum.

In the case of a hand dishwashing detergent or of a hand cleaning agent, i.e. a cleaning agent such as a washing paste for cleaning the skin surface, in particular the hand, it is also preferred that the agent according to the invention includes a skin care component. It is typically included in an amount of 0.1 to 5% in weight, preferable of 1 to 3% in weight. Suitable as skin care components are, for example, amino acids or fruit acids. Preferred is the use of proline.

In a preferred embodiment, the agent according to the invention is free of enzymes. However, within the scope of the inventive use of the agent, containing 5 to 99.9% in weight carbamide or derivatives thereof, relative to the total weight of the agent, as a dishwashing detergent or as sanitary cleaning agent is also possible that the agent contains enzymes as well. In this case enzymes are typically included in an amount of 0.01 to 5% in weight, preferably 0.1 to 3% in weight, especially 0.5 to 2% in weight, relative to the total weight of the agent.

Examples for suitable enzymes are proteases, lipases, amylases and cellulases.

In addition to the aforementioned components, the agent according to the invention can also include odorous substances. Odorous substances are natural or synthetic substances that have an odor, preferably a pleasant odor. Examples for odorous substances are:

Ambrettolide, [alpha]-amylzimtaldehyde, anethole, anisaldehyde, anisalcohol, anisol, anthranilic acid methyl ester, acetophenone, benzyl acetone, benzaldehyde, benzo acid ethyl ester, benzophenone, benzyl alcohol, borneol, bornyl acetate, [alpha]-bromstyrol, n-decylaldehyde, n-dodecylaldehyde, eugenol, eugenol methyl ether, eucalyptol, farnesol, fenchone, fenchyl acetate, geranyl acetate, geranyl formiate, heliotropin, heptin carbonic acid methyl ester, heptaldehyde, hydrochinon-di-methylether, hydroxyzimtaldehyde, hydroxyzimt-alcohol, indole, iron, isoeugenol, isoeugenol methylether, isosafrol, jasmine, camphor, carvacrol, carvone, p-cresol methylether, cumarin, p-methoxy-acetophenone, methyl-n-amylketone, methyl anthranilic acid methylester, p-methyl acetophenone, methylchavicol, p-methyl quinoline, methyl-ss-naphthylketone, methyl-n-nonyl acetaldehyde, methyl-n-nonylketone, muscone, ss-naphthol-ethylether, ss-naphthol-methylether, nerol, nitrobenzene, n-nonylaldehyde, nonylalcohol, n-octylaldehyde, p-oxyacetophenone, pentadecanolide, ss-phenylethylalcohol, phenylacetaldehyde-dimethylacetal, phenyl acetic acid, pulegone, safrol, salicylic acid isoamylester, salicylic acid methylester, salicylic acid hexylester, salicylic acid cyclohexylester, santalol, skatol, terpineol, thyme, thymol, [gamma]-undelactone, vanillin, veratrumaldehyde, zimtaldehyde, zimtalcohol, cinnamic acid, cinnamic acid ethylester, cinnamic acid benzylester, alkyisothiocyanate (alkyl mustard oil), butandion, lime, linalool, linayl acetate and propionate, menthol, menthone, methyl-n-heptenone, phellandrene, phenylacetaldehyde, terpinyl acetate, citral and/or citronellal.

It is also possible to use essential oils such as angelica root oil, anise oil, arnica blossom oil, basil oil, bay oil, champaca blossom oil, silver fir oil, silver fir cone oil, elemi oil, eucalyptus oil, fennel oil, spruce needle oil, galbanum oil, geranium oil, ginger grass oil, guaiacum oil, gurjun balsam oil, helichrysum oil, ho oil, ginger oil, iris oil, cajeput oil, calmus oil, chamomile oil, camphor oil, canaga oil, cardamom oil, cassia oil, pine needle oil, kopa[iota]vabalsam oil, coriander oil, crisped mint oil, caraway oil, cumin oil, lemon grass oil, musk grain oil, myrrh oil, clove oil, neroli oil, niaouli oil, olibanum oil, oregano oil, palmarosa oil, patchouli oil, peru balsam oil, petit grain oil, pepper oil, peppermint oil, pimento oil, pine oil, rose oil, rosemary oil, sandalwood oil, celery oil, star anise oil, thuja oil, thyme oil, verbena oil, vetiver oil, juniper berry oil, absinthe oil, winter green oil, ylang ylang oil, hyssop oil, cinnamon oil, cinnamon leaf oil and/or cypress oil.

Particularly preferred odorous substances are lime terpenes and/or orange terpenes.

Odorous substances are typically included in an amount of 0.01 to 3% in weight, preferably 0.01 to 2% in weight, relative to the total weight of the agent. If desired, a combination of 2 or more odorous substances, e.g., 2 to 10 can be used. A combination of odorous substances can be advantageous to cover potentially occurring urea odors. In addition to odorous substances, the agent according to the invention can also include colorants.

Furthermore, the agent according to the invention can contain fillers. The type and amount of fillers can be oriented on the presentation form of the agent according to the invention.

In one preferred embodiment, it is liquid agent. In this case, the filler is preferably water and/or a nonaqueous solvent.

Suitable nonaqueous solvents come, for example, from the group of one- or polyvalent alcohols, alkanolamines or glykolethers, as long as they mix with water. Preferably, the solvents are selected from ethanol, n- or i-propanol, butanols, glycol, propane or butandiol, glycerol, diglycol, propyl or butyldiglycol, hexylenglycol, ethylenglycol methylether, ethylenglycol ethylether, ethylenglycol propylether, ethylenglycol mono-n-butylether, diethylenglycol methylether, diethylenglycol-ethylether, Propylenglycol methyl, ethyl or propylether, dipropylenglycol-monomethyl or ethylether, diisopropylenglycol monomethyl or ethylether, methoxy-, ethoxy- or butoxy-triglycol, 1-butoxyethoxy-2-propanol, 3-methyl-3-methoxybutanol, propylen-glycol-t-butylether as well as mixtures of these solvents. Nonaqueous solvents can be used in the liquid dishwashing detergents or sanitary cleaning agents typically in amounts between 0.1 and 20% in weight, preferably between 1 and 10% in weight, relative to the total weight.

In a further preferred embodiment, it is a solid agent that is present in particulate form or in the form of pressed tabs. In this case, the filler is, for example, sodium sulfate, sodium chloride and/or saccharose.

In addition, salts such as sodium sulfate or sodium chloride influence the ionic strength, which can be advantageous for the cleaning activity of the agent to be used.

In one preferred embodiment, the agent according to the invention contains 0.1 to 90% in weight, more preferably 1 to 70% in weight, even more preferred 5 to 50% in weight, particularly preferred 10 to 30% in weight, especially 15 to 25% in weight of fillers, relative to the total weight of the agent.

It is also possible that an increased viscosity of the agent according to the invention is desirable. For example, the agent according to the invention may be present as a gel. In this case, water or an organic liquid, e.g., alcohol, is used as a filler and additionally a thickener is added.

The viscosity of the agent according to the invention can be determined using common standard methods (for example, Brookfield Viskosimeter RVD-VII at 20 rpm and 2O0C1 spindle 3). Preferred liquid gel-like agents can exhibit viscosities of between 20 and 4000 mPa, with values between 40 and 2000 mPa being preferred.

Suitable thickeners are inorganic or polymeric organic compounds. Mixtures of different thickeners can be used as well.

Among the inorganic thickeners are, for example, poly silicic acids, clay minerals such as montmorillonites, zeolithes, silicic acids, layered silicates and bentonite. The organic thickeners come from the groups of natural polymers, the modified natural polymers and the fully synthetic polymers. Polymers stemming from nature that are used as thickeners are, for example, xanthan, agar-agar, carrageen, tragacanth, gum arabic, alginates, pectins, polyoses, guar gum, gellan gum, carob tree gum, starch, dextrins, gelatins and casein. In the case of toilet cleaning agents, preferably xanthan is used as a thickener. In the case of liquid dishwashing detergents, preferably alginate, in particular sodiumalginate, is used as a thickener.

Modified natural substances come primarily from the group of modified starches and celluloses; carboxy methyl cellulose, hydroxy ethyl cellulose and hydroxy propyl cellulose as well as methyl hydroxy ethyl cellulose shall be named as examples.

If the agent is present in solid particulate form, the mean particle size by volume (D50) is preferably 50 to 800 μm, more preferred 100 to 600 μm, especially 150 to 450 μm. The particle size is determined in the manner described above. It is also preferred that the agent according to the invention in its particulate form exhibits a "Hausner factor" of 1.03 to 1.3, more preferred of 1.04 to 1.20 and especially of 1.04 to 1.15. The "Hausner factor" refers to the ratio of the compacted density to the bulk density. A respective particle size and a respective Hausner factor lead, for example, to an advantageous dissolution behavior and correspondingly to a better cleaning result.

The information above explained the potential components of the agent according to the invention. Basically, the individual components can be used in any combination within the scope of the stated proportions and on a broad base can lead to the development of effective cleaning agents. Exemplary, more detailed examinations were performed for the three areas of application, dishwasher detergents, hand dishwashing detergent and sanitary toilet cleaning agents, which achieved surprisingly good cleaning results. These shall be described below both in general and using specific examples with test results.

One preferred agent, in particular for use as a dishwashing detergent, in particular a dishwasher detergent, contains the following components:

1. Carbamide—25 to 75% in weight;
2. Builders—10 to 30 in weight %;
3. Tensides—2 to 25 in weight %;
4. Bleaching agents—potentially 0.1 to 5.0% in weight;
5. pH adjusters—potentially 0.1 to 10.0% in weight;
6. Odorous substances—potentially 0.01 to 1.0% in weight;
7. Stabilizers—potentially 0.1 to 5.0% in weight; and
8. Thickeners—potentially 0.01 to 2.0% in weight.

In the aforementioned embodiment of the agent for use as a dishwashing detergent, the stated tenside amount includes particularly advantageously:

1. Non-ionic tensides—1 to 5% in weight;
2. Anionic tensides—1 to 20% in weight.

One preferred agent, in particular for use as a hand dishwashing detergent (in the form of a concentrate), contains the following components:

1. Carbamide—10.0 to 20.0% in weight;
2. Amphoteric tensides—5.0 to 10.0% in weight;
3. Nonionic tensides—1.0 to 4.0% in weight;
4. Anionic tensides—5.0 to 20.0% in weight;
5. Stabilizers (e.g., glycerol)—potentially 2.0 to 7.0% in weight, e.g., 5.0% in weight;
6. Skin care components (e.g., proline)—potentially 0.5 to 3.0% in weight, e.g., 2.0% in weight;
7. Thickeners (e.g., Na alginate)—potentially 0.1 to 1.0% in weight, e.g., 0.5% in weight;
8. Antimicrobial agents (e.g., Na formiate)—potentially 0.1 to 1.5% in weight, e.g., 1.0% in weight;
9. Odorous substances/colorants—potentially 0.1 to 1.0% in weight, e.g., 0.5%;
10. Water—potentially 35.0 to 70.0% in weight.

The combination of proline and carbamide has shown to be particularly gentle to the skin.

One preferred agent, in particular for use as a sanitary cleaning agent contains the following components:

1. Carbamide—25 to 75% in weight;
2. Tensides—2 to 25% in weight;
3. Fillers—10 to 60% in weight, in particular water;
4. Bleaching agents—potentially 0.1 to 5% in weight;
5. pH adjusters—potentially 0.1 to 10% in weight;
6. Odorous substances—potentially 0.01 to 1% in weight; and
7. Thickeners—potentially 0.01 to 2% in weight.

In the aforementioned embodiment of the agent for use as a sanitary cleaning agent, the stated tenside amount includes particularly advantageously:

1. Non-ionic tensides—1 to 5% in weight;
2. Anionic tensides—1 to 20% in weight.

However, the present invention concerns not only the use of the agent according to the invention, whose weight is made up of 5 to 99.9% carbamide or derivatives thereof and possibly one or more of the components described above as a dishwashing detergent or as a sanitary cleaning agent but also a method for reducing or avoiding enzymes through the use of carbamide.

As explained above, the object of the invention is a method for reducing or avoiding enzymes in dishwashing detergents or in sanitary cleaning agents, characterized in that for an enzyme-containing dishwashing detergent or an enzyme-containing sanitary cleaning agent, a certain amount of enzymes is replaced by 5 to 50 times the amount, preferably by 10 to 40 times the amount, more preferred by 15 to 35 times the amount, especially by 20 to 30 times the amount of carbamide or derivatives thereof.

In particular, the method according to the invention is used to replace proteases.

According to the inventive method, the specialist replaces the enzyme content of an enzyme-containing cleaning agent for closed systems (in particular of an enzyme-containing agent for cleaning, sanitizing and/or disinfecting), of an enzyme-containing dishwashing detergent or of an enzyme-containing sanitary cleaning agent either in full or in part. If the enzyme-containing starting agent contains, for example, 10 g enzyme, then—with a full replacement—this amount is replaced by 50 g to 500 g carbamide. Due to the changed volume of the substituted substance, adjustments of the other components may be required, e.g., a reduction in the filler content.

The method according to the invention results in a cleaning agent, a sanitary cleaning agent or a dishwashing detergent with a reduced enzyme content or in an enzyme-free cleaning agent.

Thus, the object of the invention is also an enzyme-containing cleaning agent for closed systems, in particular an enzyme-containing agent for cleaning, sanitizing and/or disinfecting, an enzyme-free dishwashing detergent or an enzyme-free sanitary cleaning agent that contains 5 to 99.9% in weight, preferably 10 to 95% in weight, more preferred 20 to 90% in weight, even more preferred 25 to 80% in weight, particularly preferred 30 to 75% in weight, very particularly preferred 35 to 70% in weight and especially 40 to 60% in weight carbamide or derivates thereof, relative to the total weight of the enzyme-containing cleaning agent for closed systems, the enzyme-free dishwashing detergent or the enzyme-free sanitary cleaning agent. The aforementioned explanations about preferred embodiments regarding the inventive use apply to the enzyme-free dishwashing detergent or enzyme-free sanitary cleaning agent (with the exception of the optional addition of enzymes).

Finally, the inventors have found that within the scope of the invention, percarbamide can be used particularly advantageously as a bleaching agent. Thus, the object of the invention is also the use of percarbamide as a bleaching agent in cleaning agents. Specifically, the object of the invention is the use of percarbamide in dishwashing detergents, in particular for reducing or removing tar residue on dishes as well as in sanitary toilet cleaners, in particular for removing organic stains.

In summary, it shall be noted that the agent according to the invention constitutes a versatile source for numerous applications due to its unexpectedly advantageous properties. The agent according to the invention exhibits an excellent dissolving power and entrapment capacity for numerous substances. As a neutral, toxicologically harmless natural substance, the main ingredient of the agent according to the invention is very gentle to the skin and quickly biodegradable. It has been found that carbamide is an unexpectedly good solubilizer in particular in cleaning agents for closed systems (in particular in agents for cleaning, sanitizing and/or disinfecting), as well as in dishwashing detergents and sanitary cleaning agents. In spite of the high amounts of carbamide, the agent according to the invention demonstrates to be unexpectedly tolerable by the surfaces to be cleaned, for example dishes and in particular glasses. No undesirable etching effect on the surfaces was observed. In addition and unexpectedly, the agent according to the invention exhibited no unpleasant odors.

On the basis of the toxicologically and ecologically extensively harmless carbamide, the combination with other aforementioned, biologically also harmless additives, allows, for example, also formulations with the claim "bio cleaning agent".

The invention shall be illustrated based on the following examples.

EXAMPLES

Two trial series were carried out on the basis of the quality recommendations of the Industrieverband Körperpflege-und Waschmittel e.V. [German Cosmetic, Toiletry, Perfumery and Detergent Association]. Trial series A shows the advantageous properties of the agent according to the invention as a dishwashing detergent, trial series B shows the advantageous properties of the agent according to the invention as a sanitary toilet cleaner.

Trial Series A: Dishwashing Detergent

A1: Methods

The dishwashing detergents were tested according to the methods for determining the cleaning power of machine dishwashing detergents, IKW (Industrieverband Körperpflege und Waschmittel e.V.), Frankfurt a.M.; Reprint from SÖFW-Journal, 124. Volume 11/98).

The cleaning power of formulations according to the invention were tested in the following equipment:

1. Dish washer: Bomann Tisch-Geschirrspüler TSG 704 [Bowman dishwasher TSG 704]

The following parameters were selected:

| | |
|---|---|
| 1. Program: | Fast |
| 2. Water temperature | Wash 49° C./Rinse 55° C. |
| 3. Program duration + hold time: | 60 minutes |
| 4. Water consumption: | 9.6 liters |
| 5. Dosage detergent: | 10 g per rinse cycle |
| 6. Dosage rinse aid | no rinse aid used |
| 7. Dosage ballast soil: | 15 g per rinse cycle |

To achieve a better differentiation of the individual test products, a ballast soil was added in the test to the cleaning cycle in addition to the described individual soils. This ballast soil in the form of a deep-frozen soil cube consists primarily of fatty components as well as foods containing proteins and starch. This additional soil was to simulate the soil addition via food rests that is easy to remove and was to put an additional load on the dishwasher.

The various dishes had to undergo a basic cleaning before the individual soils were added. This is necessary in particular because due to the great stubbornness of some soils, residues from previous trials might still be present on the dishes. Also newly used dishes were to undergo three basic cleanings prior to their first use. The trial soiling was generated as follows:

1. Ground Meat on China Plates 225 g ground meat (half/half) and 75 g whole egg mixed together Stir ground meat/egg mixture (300 g) in 80 ml water and then homogenize with a kitchen mixing rod for 2 min Weigh 3 g±0.1 g of this mixture onto each plate and distribute evenly Let dry for 2 h at 70° C. in a drying oven Evaluation: Visually according to IKW photo catalog after coloration with carbol gentian violet Starch Mixture Preparation for 6 plates:

Dissolve 2.6 g starch mix (potato and corn starch) in 200 ml of water

Heat this 1.3% starch solution for 10 min at 95° C. (cover glass beaker with aluminum foil)

Weigh 29.5 g±0.1 g of this solution onto each plate

Let dry for 4 h at 70° C. in a drying oven

Weigh the plates after drying

Evaluation:

$$\% \text{ cleaning power} = \frac{\text{mg starch dissolved}}{\text{mg starch deposited}} \times 100$$

Coloration with iodine (2.5 mM) was done for better visual inspection

Oat Meal

Preparation for 6 plates:

Boil 25 ml milk (1.5% fat), 75 ml water and 5 g oat meal for 10 min

Distribute 3 g oat meal soup evenly on inner surface of plate

Let dry for 2 h at 70° C. in a drying oven

Evaluation: Visually according to IKW photo catalog after coloration with iodine (2.5 mM)

Egg Yolk

Separate egg yolk from raw eggs

Weigh 1.0 g±0.1 g egg yolk mass into each stainless steel bowl and distribute evenly Let dry for 30 min at 70° C. in a drying oven Weigh the plates after drying Evaluation:

$$\% \text{ cleaning power} = \frac{\text{mg egg yolk dissolved}}{\text{mg egg yolk deposited}} \times 100$$

A2: Assessment

The cleaning power of different formulations was assessed. The higher the point score, the better the cleaning power.

A3: Formulations

The following solid cleaning formulations were produced:

Example A3-1

| Formulation | [% in weight] |
|---|---|
| Carbamide | 50 |
| Sodium sulfate | 15.5 |
| Sodium citrate | 15.5 |
| Span ® 80 | 5 |
| Pluriol ® E 4000 | 5 |
| Percarbamide | 2 |
| Sodium carbonate | 5 |
| Limes | 1 |
| Alginate | 1 |

Example A3-2

| Formulation | [% in weight] |
|---|---|
| Carbamide | 50 |
| Sodium sulfate | 13 |
| Sodium citrate | 13 |
| Span ® 80 | 5 |
| Pluriol ® E 4000 | 5 |
| Percarbamide | 2 |
| Sodium carbonate | 10 |
| Limes | 1 |
| Alginate | 1 |

Example A3-3

| Formulation | [% in weight] |
|---|---|
| Carbamide | 50 |
| Sodium sulfate | 16.5 |
| Sodium citrate | 16.5 |
| Span ® 80 | 5 |
| Pluriol ® E 4000 | 5 |
| Percarbamide | — |
| Sodium carbonate | 5 |
| Limes | 1 |
| Alginate | 1 |

Example A3-4

| Formulation | [% in weight] |
|---|---|
| Carbamide | 50 |
| Sodium sulfate | 16 |
| Sodium citrate | 16 |
| Span ® 80 | 5 |
| Pluriol ® E 4000 | 5 |
| Percarbamide | — |
| Sodium carbonate | 5 |
| Limes | 1 |
| Alginate | 1 |

Example A3-5

| Formulation | [% in weight] |
|---|---|
| Carbamide | 50 |
| Sodium sulfate | 16 |
| Sodium citrate | 16 |
| Marlox ® MO 154 | 5 |
| Pluriol ® E 4000 | 5 |
| Percarbamide | — |
| Sodium carbonate | 5 |
| Limes | 1 |
| Alginate | 1 |
| Enzymes | 1 |

Example A3-6

| Formulation | [% in weight] |
|---|---|
| Carbamide | 50 |
| Sodium sulfate | 16.5 |
| Sodium citrate | 16.5 |
| Marlox ® MO 154 | 5 |
| Pluriol ® E 4000 | 5 |
| Percarbamide | — |
| Sodium carbonate | 5 |
| Limes | 1 |
| Alginate | 1 |
| Enzymes | — |

The following liquid cleaning formulations were produced:

Example A3-7

| Formulation | [% in weight] |
|---|---|
| Water | 60.5 |
| Carbamide | 30 |
| Marlox ® MO 154 | 5 |
| Pluriol ® E 4000 | 2 |
| Sodium alginate | 1 |
| Enzymes | 1 |
| Fragrance/color | 0.5 |

| Example A3-8 | |
|---|---|
| Formulation | [% in weight] |
| Water | 65.5 |
| Carbamide | 25 |
| Marlox ® MO 154 | 5 |
| Pluriol ® E 4000 | 2 |
| Sodium alginate | 1 |
| Enzymes | 1 |
| Fragrance/color | 0.5 |

| Example A3-9 | |
|---|---|
| Formulation | [% in weight] |
| Water | 60.5 |
| Carbamide | 30 |
| Tween80 | 5 |
| Pluriol ® E 4000 | 2 |
| Sodium alginate | 1 |
| Enzymes | 1 |
| Fragrance/color | 0.5 |

With the cleaning agents in liquid form, the formulations A3-7 and A3-9 were particularly convincing with regard to stability over a broad temperature range.

Selected as a reference standard was a commercially available powder dishwashing detergent of a leading manufacturer (containing >30% phosphates, 5-15% acid-based bleaching agents, less than 5% nonionic tensides, polycarboxylates, enzymes (protases, amylases).

A4: Results

The formulates described in A3 were tested according to the method described in A1 and assessed according to A2. It was found that all recommended formulations fulfill the requirements for a commercially available dishwashing detergent.

The cleaning power of the particularly preferred formulations A3-5 and A3-7 were computed as an example:

| Soiling | Examp. A3-5 | Examp. A3-7 |
|---|---|---|
| Ground meat on china plates | 92 ± 7 | 83 ± 11 |
| Oat meal | 88 ± 7 | 77 ± 9 |
| Starch mixture | 99 ± 1 | 95 ± 1 |
| Egg yolk | 98 ± 2 | 96 ± 4 |

It could be demonstrated that the cleaning power of the formulation A3-5 was significantly above the reference standard in all categories (ground meat, oat meal, starch mixture and egg yolk). The formulation A3-7 was also significantly above the reference standard in the categories oat meal, starch mixture and egg yolk.

A5: Discussion

In summary, it should be stated that the cleaning power of the formulations according to the invention corresponds to and often even surpasses the reference standard. It has also been demonstrated that due to the present invention, enzymes can be reduced significantly or can be omitted entirely.

Trial Series B: Sanitary Toilet Cleaning Agent

B1: Methods

On the basis of the quality recommendations of the Industrieverband Körperpflege-and Waschmittel e.V. [German Cosmetic, Toiletry, Perfumery and Detergent Association] (IKW, Department Cleaning Agents and Care Products) a comparable trial method for evaluating the quality of acidic toilet cleaning agents was developed. The sanitary toilet cleaning agents were tested according to the recommendation for the quality evaluation of acidic toilet cleaning agents/quality recommendation of the Industrieverband Körperpflege-und Waschmittel e.V. (IKW), Department Cleaning Agents and Care Products, Frankfurt a.M. (1999 Version).

Examined was the dissolving power of the respective formulations for limestone. The known commercially available product served again as a reference standard.

Before beginning with the trial series, a marble slab had to be crushed using a hammer and a chisel. Care was taken that the respective pieces were as uniform as possible and exhibited a comparable mass (about 13±1 g), in order to obtain no deviations during the gravimetric evaluation. Then, the marble pieces were washed thoroughly and dried over night in a drying oven until they reached a constant weight.

For the test, two marble pieces were weighed on an analytical balance such that the total mass was about 25±1 g. Thereafter, they were placed for 15 min into a glass beaker containing 50 g of the test products with the requirement that the pieces were fully covered by the cleaning agent. After the end of this time, the pieces were cleaned thoroughly under running water and then dried until they reached a constant weight in order to be able to determine gravimetrically the dissolved amount of lime.

To be able to compare the test products directly with other products, they were tested as a 20% solution and compared to a 20% reference standard solution.

To determine the limescale dissolving power (LDP) of a product and to improve the statistics, 6 trials were carried out with different marble pieces and a fresh cleaning agent solution each time.

Care was taken that the trials were carried out in a temperature range of 20 to 23° C., i.e., that the temperature of the surroundings, of the products and of the marble carrier were within this temperature range.

B2: Assessment:

The amount of dissolved calcium carbonate was placed in relation to the described standard toilet cleaning agent in a 20% solution.

$$\text{Calculation limestone dissolution index } (LDI) = \frac{LDP \text{ mg test product}}{LDP \text{ mg standard sanitary toilet cleaner}}$$

The limescale dissolution index was to be at least 0.7. In practical applications, it was demonstrated that values above 1.3 were not necessary.

A commercially available sanitary toilet cleaner of a known manufacturer was used as the "standard sanitary toilet cleaning agent".

B3: Formulations

| Example B3-1 | |
|---|---|
| Formulation | [% in weight] |
| Water | 61.5 |
| Carbamide | 25 |
| Citric acid | 10 |
| Marlinat ® 242/70 | 3 |

-continued

| Example B3-1 | |
|---|---|
| Formulation | [% in weight] |
| Xanthan gum | 0.5 |
| NaCl | — |
| pH value | 2.33 |
| pH value (20% solution) | 2.18 |

| Example B3-2 | |
|---|---|
| Formulation | [% in weight] |
| Water | — |
| Carbamide | 25 |
| Citric acid | 10 |
| Marlinat ® 242/70 | 3 |
| Xanthan gum | 0.5 |
| NaCl | 61.5 |
| pH value | — |
| pH value (20% solution) | 1.62 |

B4: Results:

| Sample name | Lime dissolving power LDP [mg] | Lime dissolution index LDI |
|---|---|---|
| 20% reference standard (pH value: 2.43) | 121 ± 7 | 1.00 |
| 20% example B3-1 | 153 ± 14 | 1.27 |
| 20% example B3-2 | 109 ± 6 | 0.90 |

In addition, the formulation B3-1 was tested for its thermal stability. The assessment was visual. At 8° C., 25° C., 30° C. and 40° C., the formulation was clear and liquid.

B5: Discussion

It was demonstrated that the formulations according to the invention showed an advantageous cleaning effect and at the same time an advantageous stability. It also became apparent that the formulations according to the invention allowed cleaning that was gentle to the surface. The intensive black color of the marble pieces used for the test remained intact.

There has thus been shown and described a novel use of an agent that contains carbamide and/or at least a derivative thereof as a cleaning agent which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

The invention claimed is:

1. The method of using a cleaning agent that contains (a) 10 to 90% in weight of carbamide;

(b) 0.1 to 40% in weight of at least one of an anionic tenside, nonionic tenside, amphoteric tenside and a cationic tenside;

(c) 0.01 to 20% in weight of a chelating agent, all percentage weight amounts relative to the total weight of the cleaning agent; and (d) a salt influencing the ionic strength of the cleaning agent, the method comprising applying the cleaning agent as at least one of a cleaning agent for closed systems, an agent for cleaning food processing equipment, an agent for cleaning, sanitizing and disinfecting medical equipment, a hand dishwashing detergent, a sanitary cleaning agent, and a hand cleaning agent.

2. The use as set forth in claim 1, wherein the agent contains 30 to 75% in weight of carbamide, relative to the total weight of the agent.

3. The use as set forth in claim 1, wherein the agent contains 0.1 to 50% in weight, relative to the total weight of the agent, of a builder.

4. The use as set forth in claim 1, wherein the agent contains 0.1 to 10% in weight, relative to the weight of the agent, of a bleaching agent.

5. The use as set forth in claim 4, wherein the bleaching agent is percarbamide.

6. The use as set forth in claim 1, wherein the agent contains 0.1 to 10% in weight of a pH adjuster, relative to the total weight of the agent.

7. The use as set forth in claim 1, wherein the agent contains 0.1 to 10% in weight of a chelating agent, relative to the total weight of the agent.

8. The use as set forth in claim 1, wherein the agent contains 0.1 to 5% in weight, relative to the total weight of the agent, of a stabilizer.

9. The use as set forth in claim 1, wherein the agent contains at least one of an antibacterial additive, an antimycotic additive and a antimicrobial additive in an amount of 0.1 to 2% in weight, relative to the total weight of the agent.

10. The use as set forth in claim 1, wherein the agent contains 0.1 to 5% in weight of skin care components, relative to the total weight of the agent.

11. The use as set forth in claim 1, wherein the agent contains 0.01 to 2% in weight, relative to the total weight of the agent, of odorous substances.

12. A method for reducing or eliminating enzymes in a cleaning agent selected from the group consisting of a cleaning agent for closed systems, a cleaning agent for food processing equipment, an agent for cleaning, sanitizing and disinfecting medical equipment, a hand dishwashing detergent and a sanitary cleaning agent, said method comprising the step of substituting a certain amount of enzymes by 5 to 50 times that amount of a carbamide, wherein the cleaning agents contain (a) 10 to 90% in weight of carbamide;

(b) 0.1 to 40% in weight of at least one of an anionic tenside, nonionic tenside, amphoteric tenside and a cationic tenside;

(c) 0.01 to 20% in weight of a chelating agent;

all percentage weight amounts relative to the total weight of the cleaning agent; and (d) salts influencing the ionic strength of the cleaning agent.

13. A method of using the cleaning agent defined in claim 12, wherein the cleaning agent is applied as one of an enzyme-free cleaning agent for closed systems, an enzyme-free dishwashing detergent and an enzyme-free sanitary cleaning agent, respectively.

14. The use as set forth in claim 1, wherein the cleaning agent for closed systems is applied as at least one of a dishwasher detergent and a laundry detergent for washing machines.

15. The method defined in claim 13, wherein the cleaning agent for closed systems is used as at least one of a dishwasher detergent and a laundry detergent for washing machines.

16. The use as set forth in claim 1, wherein the sanitary cleaning agent is applied as a toilet cleaning agent.

17. The use as set forth in claim 10, wherein the agent is applied as a hand dishwashing detergent.

18. The use as set forth in claim 1, wherein the agent contains as salt influencing the ionic strength includes at least one of sodium sulfate and sodium chloride.

19. The use as set forth in claim 8, wherein the stabilizer includes at least one of glycol, propylene glycol, polyalkylene glycol, in particular polyethylene glycol and polypropylene glycol, glycerol, sorbitol, mannitol and a mixture thereof.

20. The use of an agent as set forth in claim 1, wherein the agent contains 0.01 to 5% in weight, relative to the total weight of the agent, of an enzyme.

21. The use of an agent as set for in claim 1, wherein the agent contains 0.1 to 50% in weight, relative to the total weight of the agent, of builders.

22. The use as set forth in claim 21, wherein the builders include at least one of aluminosilicates, zeolites, alginates, polyacrylates and polyacetales.

23. The use as set forth in claim 1, wherein the chelating agents are nitrilo triacetate (NTA), ethylene diaminotriacetate (TED), ethylene diamine tetraacetate (EDTA), oxalate, tartrate and/or citrate.

24. The use as set forth in claim 1, wherein the agent is a liquid which contains at least one of water and a non-aqueous solvent.

25. The use as set forth in claim 1, wherein the agent is a solid in at least one of particulate form and the form of pressed tabs.

26. The use as set forth in claim 1, as a dishwashing detergent, wherein the agent is in liquid form, and includes water having a pH-value of 7 to 12 and also an alkaline agent as pH adjuster.

27. The use as set forth in claim 26, wherein the alkaline agent includes at least one of an alkaline active alkaline salt, an earth alkaline salt, an alkaline hydroxide and an earth alkaline hydroxide.

28. The use as set forth in claim 1, for sanitary cleaning agents for dissolving calcifications, wherein the agent is in liquid form and includes water having a pH-value of 1 to 6 and also an acidifying agent as pH-adjuster.

29. The method defined in claim 10, wherein the cleaning agent is applied one of an enzyme-free cleaning agent for closed systems, an enzyme-free dishwashing detergent and an enzyme-free sanitary cleaning agent, respectively.

30. The method as set forth in claim 29, wherein the cleaning agent for closed systems is applied as at least one of a dishwasher detergent and a laundry detergent for washing machines.

* * * * *